United States Patent [19]

Aidlin et al.

[11] 4,017,330

[45] Apr. 12, 1977

[54] METHOD AND APPARATUS FOR INTERNAL SPRAY CLEANING OF CONTAINERS

[76] Inventors: Samuel S. Aidlin, 214 Beaumont St., Brooklyn, N.Y. 11235; Stephen H. Aidlin, 934 Glenwood Road, West Hempstead, N.Y. 11581

[22] Filed: Feb. 27, 1976

[21] Appl. No.: 662,028

[52] U.S. Cl. ..... 134/21; 15/302; 15/304; 134/25 R; 134/48; 134/77; 134/151

[51] Int. Cl.[2] ..... B08B 5/04

[58] Field of Search ..... 134/43, 48, 77, 134, 134/151, 21, 25 R; 15/302, 304

[56] References Cited

UNITED STATES PATENTS

| | | | |
|---|---|---|---|
| 2,304,050 | 12/1942 | Risser | 15/304 |
| 3,614,958 | 10/1971 | Perrier | 134/48 |

*Primary Examiner*—Arthur D. Kellogg
*Attorney, Agent, or Firm*—Martin Smolowitz

[57] ABSTRACT

The present invention applies pressurized air and vacuum to container interiors as they are being conveyed through the cleaning station in the course of their forward travel. Cleaning according to the invention occurs through the combined action of a plurality of air jets which dislodge any foreign matter from the container interior and a vacuum drawn through an arcuate slot evacuates and draws out the dislodged contaminents. The aforementioned operation taking place as containers continuously advance in a circular conveyor in the opening down position. After this operation, the containers are urged to assume a horizontal position and are subsequently oriented into the opening up position for travel to a new work station.

13 Claims, 3 Drawing Figures

METHOD AND APPARATUS FOR INTERNAL SPRAY CLEANING OF CONTAINERS

The present invention is directed to an apparatus for the removal of impurities, such as, dust, residual material, etc. primarily from the interior surfaces of a container, prior to filling such container. More particularly, the invention is directed to an automatic apparatus for sequentially treating containers such as plastic bottles, prior to the introduction of product, so as to render them free from impurities and contaminents.

Obviously, it is most desirable to provide a clean and impurity free container prior to introduction of end product therein so as not to contaminate such product. This is particularly important, when the ultimate product is to be ingested, such as foodstuffs, drugs, etc. or is in some fashion or form applied to a surface which can be adversely affected by contaminents. A number of serious disadvantages exist with commercially available equipment used in the container cleaning operation. A common characteristic of all such equipment is that it functions differently from situation to situation depending upon the orientation of the container during the feeding operation and the manner of cleaning. In other words, if containers are fed in the open end up position, rather than in the open end down position; or if they are fed horizontally disposed instead of vertically, additional equipment is usually required to correctly position the container for cleaning. It follows that substantial auxiliary equipment may be required in conjunction with certain conventional container conveyors. For an example, in a known container cleaning system, a pair of belts having associated spring loaded fingers are employed for engaging containers in the upright position between such belts. Subsequently, the containers are reversed and positioned in the opening down position by the turning action of the belts, and then such containers are directed to the cleaning device for impurity removal. Such apparatus has a number of disadvantages, including: being quite complex, expensive to operate and maintain, containers during movement are not in operator view for monitoring, and the apparatus does not lend itself to the standard method of hopper feeding of containers.

The apparatus of the present invention applies pressurized air and vacuum to container interiors as they are being conveyed through the cleaning station in the course of their forward travel.

The principal features of the present invention are directed to an apparatus for purging containers from impurities prior to filling as said containers are being continuously conveyed in an opening down orientation by directing separate streams of fluid under pressure through said opening at the upper portion of said containers whereby said streams cooperate to dislodge and evacuate said impurities from interior surfaces of said containers, said apparatus including: slotted orifice means disposed in the path of travel of said containers for drawing a negative pressure across said container opening; a plurality of individual spaced apart orifice means disposed in proximity to and on either side of said slotted orifice means providing individual pressurized jet streams into said container opening; conveyor means for conveying said containers along a predefined path for aligning the central axis of said container openings with the longitudinal axis of said slotted orifice means; restraining means for restraining the movement of said containers while under the influence of said respective streams; and means to position said containers after purging, for advancement on to additional conveyor means for filling.

Also within the scope of the invention is a nozzle means for directing a pressurized jet stream for impingement upon said lower portion of each of said containers to thereby urge said containers to abut against said guide means while under the continued influence of said stream or by suitable cam action and causing said containers to pivot and assume a horizontal position with coincidental movement of said lower portion of said containers out of said recesses to a maximum distance defined by the position of an abutment means disposed about the outer periphery of said conveyor means; and container orientation means disposed adjacent said conveyor means for engaging said horizontally disposed containers and guiding said containers into a vertical opening-up position.

A further feature of the invention is directed to a method of purging interior surfaces of containers having openings therein, while continuously advancing in a forward direction on a rotatable conveyor provided with a series of recesses for receiving said containers, advancing each of said containers in the opening down position past a cleaning station for the removal of contaminents and thereafter reorienting each of said containers in the opening up position for further handling.

Cleaning according to the invention occurs through the combined action of a plurality of air jets which dislodge any foreign matter from the container interior and a vacuum drawn through an arcuate slot evacuates and draws out the dislodged contaminents. As used in this specification, the term container is intended to refer to any type of open ended container such as, for example, jars, bottles, tubes, etc., with the shape of such container being of the standard variety, such as: cylindrical, square, hour-glass, tapered, etc. After containers have been dispensed from a hopper through a chute, they are disposed into a star wheel and thence onto a conveyor for travel to the filling station. Contaminents present on the internal surfaces of the containers are removed as the containers are conveyed with their respective openings facing down. Once cleaned, the containers as they travel in the forward direction are positioned with the openings facing up through a two step operation. Firstly, an air jet directed upon the lower portion of the container as it freely nestles in the conveying device, urges it to assume a horizontal position with its opening facing away from the interior of the conveyor. Suitable camming action can also be employed to horizontally position the container. Secondly, the upper portion of the container is urged to engage an orientation member while the container is being conveyed and travels in a progressively upward direction until fully righted, with the opening facing up.

The present invention has been found to operate satisfactorily in conjunction with a container conveying device of the type identified in U.S. Pat. No. 3,380,627. Accordingly, individual containers, for example, plastic bottles with necks, are fed from a standard hopper in the neck down position into a star wheel conveyor, from whence they ultimately proceed to a flat belt conveyor for filling with product. To provide for uniform flow, the rate of travel of the rotating star wheel is equal to that of the flat belt conveyor.

Accordingly, it is the main object of the present invention to provide an apparatus free of the defects of the prior art.

Still another object of the present invention is to provide an apparatus for removing impurities from the interior of containers in a fast, efficient, and trouble free manner without the need for expensive and complicated equipment.

A further object of the present invention is to provide a cleaning apparatus which operates to clean containers while in the opening down position and has associated means for placing such cleaned containers into the opening up position.

The aforementioned objects and advantages of the present invention will be more fully understood with respect to the accompanying specification, claims and drawings.

IN THE DRAWINGS

As mentioned above, the present invention has been found particularly useful in connection with the structure disclosed in U.S. Pat. No. 3,380,627 which is directed to an apparatus for receiving and conveying articles such as containers from a source of supply, and to assure that the containers are properly fed to a conveyor belt and remain in an upright position on the conveyor belt in regulated timed and space relationship.

Figure 1:
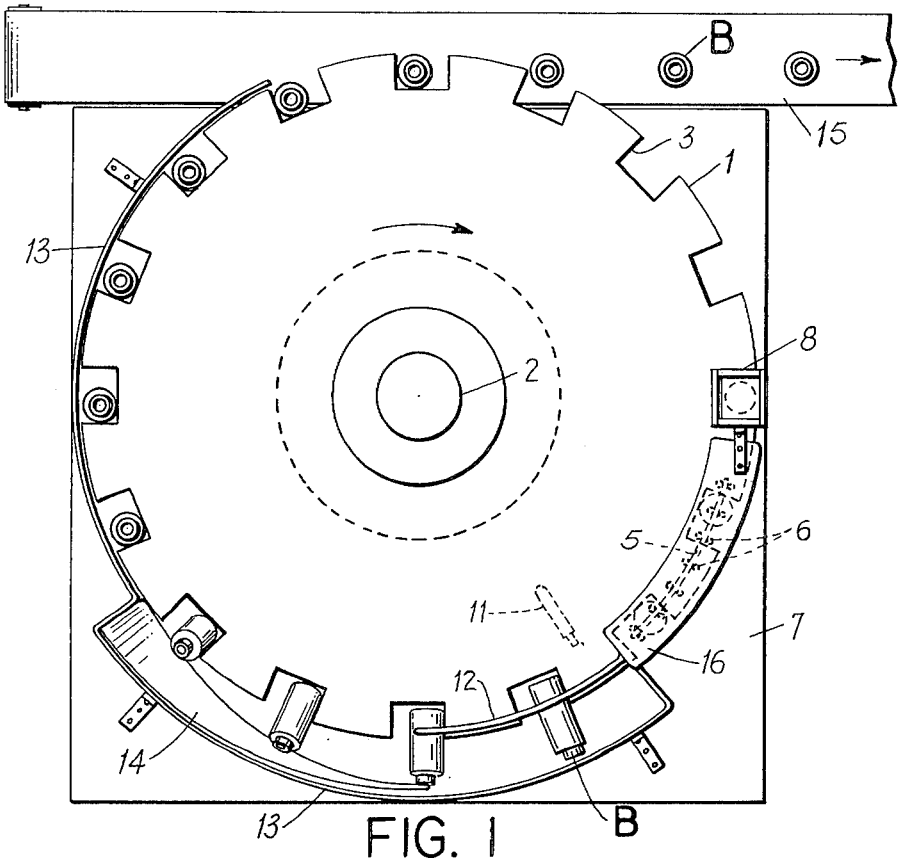
FIG. 1 is a plan view of the invention.

The apparatus shown in FIG. 1 employs a star wheel 1 mounted on a rotatable shaft 2 and is provided with a series of spaced recesses or pockets 3 preferably U shaped, disposed about the periphery of the star wheel 1. The star wheel 1 is mounted to freely rotate with sufficient clearance above the top surface 7 of a table 4 containing a motor and associated coupling elements for driving the star wheel 1, as well as the necessary controls associated with the invention. As containers, for example, plastic bottles B, are fed into each of the recesses 3 of the star wheel 1 from a hopper through chute 8, the star wheel 1 rotates and bottles in the opening down position are conveyed past a first operating station, the cleaning station. The cleaning station is disposed beneath the star wheel 1 and is located along the top surface 7 of table base 4. Cleaning is effected via a slotted arcuate shaped orifice 5 surrounded by a plurality of spaced apart circular orifices 6 on either side of the slotted orifice 5. The arcuate center line of the slotted orifice 5 is designed to be in alignment with the centerline of the openings of bottles B during travel in star wheel 1. In operation, a vacuum formed through slotted orifice 5 operating at about two inches of water pressure, cooperates with jets of pressurized air exiting from the orifices 6 at approximately 40 psi. The aforementioned operating pressures are included merely for illustrative purposes and obviously may be varied as operating conditions dictate. Normally, once the operator initiates the container conveying cycle, such as by a suitable switch means, the cleaning operation is simultaneously begun by opening appropriate valving causing compressed air to pass through the orifices 6 and a vacuum to be drawn through slotted orifice 5 respectively, by employing conventional associated manifolding and a suitable commercially available vacuum cleaner with receptacle attached thereto. At the end of the conveying cycle, the operator would de-energize the conveyor and cleaning apparatus in a similar fashion. Of course, the invention can be modified to operate with other than ambient air, for example, where conditions warrant, de-ionized air can be employed.

Figure 2:
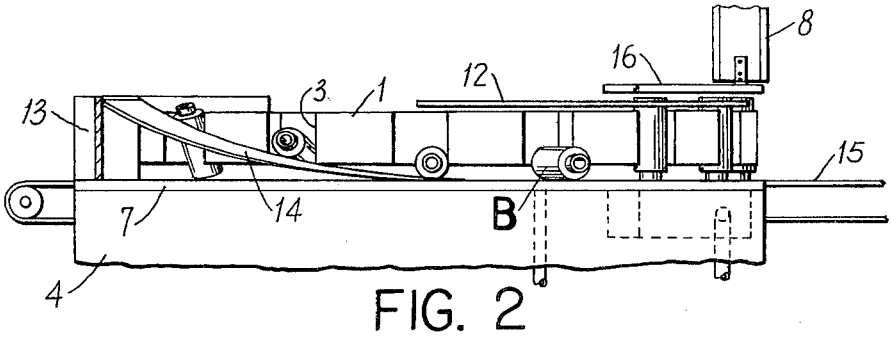
FIG. 2 is a side elevational view of FIG. 1 with the abutment removed.
Figure 3:
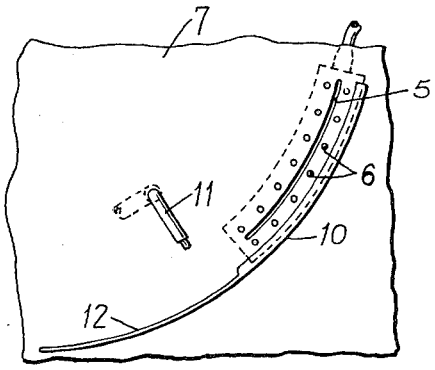
FIG. 3 is a fragmentary plan view of FIG. 1.

An adjustable top member 16, to be explained in more detail hereinafter, is mounted above the cleaning station and serves to prevent uncontrolled container movement during cleaning. When required, a supplemental guide 10 as explained hereinafter, aids in the proper positioning of the containers. An elongated nozzle 11 disposed upstream and in close proximity to slotted orifice 5 and orifices 6, per FIG. 2, lies in a plane parallel to and near the surface 7 of table 4, at a sufficient clearance with the underside of the star wheel 1 so as not to interfere during rotation. The working end of nozzle 11 is directed away from the center of star wheel 1 and terminates at the root diameter of the recess 3 so as to effectively operate on bottle B. As the star wheel 1 continues to rotate (after cleaning) the bottles B in the respective recesses 3 pass nozzle 11 where a jet of pressurized air fed and energized through suitable commercially available valving and manifolding, impinges upon the lower most portion of bottle B, which up to this time is still in the opening down position. During the action of the jet upon the bottle B, the upper portion of the container is directed to abut against an arcuate shaped member 12 extending from and being continuous with guide 10, resulting in downward movement of the bottle B from the vertical position. As this occurs, the lower most portion of the container (the open end) under the influence of the jet continuously moves out from the interior of recess 3 into a space towards peripheral abutment 13. Abutment 13 mounted to the top of table 4 extends around to conveyor 12 at the outer periphery of star wheel 1 and defines the outer limit of travel of the bottles B during the cleaning and orienting operation. As the star wheel 1 continues to rotate with bottles B in recesses 3, the neck portion of bottle B advances onto a flat curvalinear orientator 14 disposed tangentially of the star wheel 1 and extending for a prescribed distance in a space between the abutment 13 and the star wheel 1. The bottle B travels along the orientator 14 until it rights itself on its base and is in the opening up position.

Operation of the aforementioned apparatus will be explained in more detail with respect to a typical operation employing a plastic bottle having a neck portion with an opening. Cleaning takes place by having the interior of the bottle subjected to a plurality of pressurized air streams provided through a series of orifices 6 causing any impurities and contaminents which may have accumulated therein to disperse. Simultaneously, a vacuum is drawn through slotted orifice 5 which serves to evacuate the dislodged impurities through the bottle opening and into a suitable receptacle attached at the end of the exhaust to slotted orifice 5.

Shortly after the star wheel 1 conveys bottles B past the cleaning station, they arrive at an orientation station. Here, nozzle 11 disposed above the table base 4, and parallel with the top of the table 4, provides an air jet which impinges upon the lower portion of the bottle B, (the neck which is facing downward) to cause the bottle B to pivot about arcuate shaped member 12 at the point of contact therewith, and progressively assume a horizontal position with neck or open portion of the bottle B moving away from the interior of the recess 3 for engagement by orientation 14 further upstream. This operation is continuously being carried out as fresh bottles B in respective recesses 3 are being conveyed by rotating star wheel 1. During the initial phase of the orientation operation, the major portion of the body of the bottle B remains within the recess 3 after passing the nozzle 11 with the result that, as star wheel 1 continues to rotate, the neck portion which is extending out of the recess and is unsupported, freely comes under the influence of the specially shaped guidance surface of orientator 14. Orientator 14 is formed of a single member having its narrowest width at the point closest to the surface of table 4 from which point it gradually widens as it slopes upwardly away from the table surface 7 ending in a rounded portion. The active surface of orientator 14 is curvalinear in character being of sufficient slope and having sufficient curvature to enable the bottles to assume an opening up position. The orientator being adjustable in the vertical direction, can be positioned to function with different sizes and types of bottles. However, different types and sizes of bottles naturally require differently contoured orientators 14, since proper operation dictates that the high point of contact of the orientator 14 with respect to the bottle B need be above the center of gravity of the bottle. Peripheral abutment 13 surrounding the outer portion of orientator 14 cooperates to constrain the outer limits of bottle travel during movement on orientator 14. Under the action of orientator 14 and moving star wheel 1, bottles B are continuously urged to assume an upright position for placement on to flat belt conveyor 15 located at a point upstream to the side of star wheel 1.

Bottles B in the cleaning station are positioned in star wheel 1 are in open end down position being stabilized and constrained from flying off by several arcuate shaped cooperative members.

An arcuate shaped top member 16 extending for about the distance of two recesses and the land area therebetween is of sufficient width to restrain the bottle surfaces in proximity thereto. Top member 16 is adjustable in the vertical direction depending upon the size of bottle and is mounted by suitable brackets to the peripheral abutment 13. The supplemental guide 10 mounted below and spaced from top member 16, is narrower in width and provides additional stability to the bottle by constraining lateral movement with respect to slotted orifice 5. However, in some instances, depending upon bottle size, the supplemental guide 10 may not be necessary due to the presence of peripheral abutment 13 and in such cases is merely formed as part of the relatively thin arcuate shaped member 12. The member 12 is provided with an active surface extending to a point beyond the cleaning station into and above the line of action of orientator 14 and serves to cooperate with the jet of air from nozzle 11. The force exerted against the bottle by the jet impinging on the lower portion of the bottle B, results in bottle movement out of the recess 3 against the member 12. During this impingement, sufficient momentum is imparted to the bottle resulting in bottle movement about member 12 and and eventual horizontal positioning, with the bottle opening facing the orientator 14. After this operation, the bottles B as they freely nestle in the star wheel 1 engage the lowest most and narrowest portion of the orientator 14 for upward movement on the curved surface of the orientator until the righting operation is completed.

The invention has been found to function and handle up to 300 bottles per minute. Of course, the position of the orifices 6 and nozzle 11, as well as the slotted orifice 5 are in fixed relationship with respect to the center line of rotation of star wheel 1 enabling use of the basic system with different types of containers.

It will be understood that various departures from the specifically disclosed embodiments of the invention may be effected without departing from the scope thereof as defined by the following claims:

We claim:

1. An apparatus for purging containers from impurities prior to filling as said containers are being continuously conveyed in an opening down orientation by directing separate streams of fluid under pressure through said opening to dislodge and evacuate said impurities from interior surfaces of said containers, said apparatus including: arcuately shaped slotted orifice means disposed in the path of travel of said containers for drawing a negative pressure across said container opening; a plurality of spaced apart orifice means disposed in parallelism to and on either side of said slotted orifice means providing individual pressurized jet streams for action upon said container interior through said container opening; conveyor means for conveying said containers along a predefined path for aligning the central axis of said container openings with the longitudinal axis of said slotted orifice means; overhead restraining means for restraining the movement of said containers while under the influence of said respective streams; and means to position said containers after purging, for advancement on to additional conveyor means for filling.

2. An apparatus as claimed in claim 1, wherein: said conveyor means being rotatably mounted above stationary table means; said conveyor means being provided with a plurality of individual recesses for receiving containers from a source of supply in the opening down position and being adapted to advance said containers upstream whereby the central axis of each of said container openings being in alignment with respect to the central axis of said arcuately shaped slotted orifice means formed of said table means.

3. An apparatus as claimed in claim 2, wherein: said conveyor means for conveying said containers in an opening down position being a rotatably mounted star wheel disposed to move above a working surface formed of said table means defining said slotted orifice means and said plurality of individual spaced apart orifice means, whereby respective interior surfaces of each of said containers are cleaned through the combined influence of each of a series of jet streams and vacuum acting through said respective container openings as each of said containers advance along said orifice means.

4. An apparatus as claimed in claim 3, wherein: said plurality of individual spaced apart orifice means on either side of said slotted orifice means, being formed of pairs of parallel outer jet streams conforming to an arcuate contour of said slotted orifice means for dislodging impurities from said container interior and permitting evacuation of said impurities through said slotted orifice means.

5. An apparatus as claimed in claim 1, wherein as said restraining means being defined by: first abutment means disposed above said conveyor means and second abutment means positioned about the periphery of said conveying means.

6. An apparatus as claimed in claim 5, wherein: said first abutment means being defined by flat arcuate member mounted to said second abutment means, overhanging the line of travel of said containers and extending for a distance defined by the arcuate travel of at least two conveyor recesses and the area therebetween.

7. An apparatus as claimed in claim 1, wherein said means to position said containers after purging includes: nozzle means dispatched beneath said conveyor means, along the path of travel of a lower portion of said containers; guide means mounted above the path of travel of said conveying means, extending within the locus of travel of said containers advancing in said conveyor means, adapted to co-act with each of said containers; and orientation means positioned in proximity to said guide means, for directing each of said containers into position for advancement to a new work station.

8. An apparatus as claimed in claim 7, wherein: said nozzle means being adapted to direct a pressurized jet stream for impingement upon said lower portion of each of said containers to thereby urge said containers to abut against said guide means while under the continued influence of said stream and causing said containers to pivot and assume a horizontal position with coincidental movement of said lower portion of said containers out of said recesses to a maximum distance defined by the position of an abutment means disposed about the outer periphery of said conveyor means; and container orientation means disposed adjacent said conveyor means for engaging said horizontally disposed containers and guiding said containers into a vertical opening-up position.

9. An apparatus as claimed in claim 7, wherein: said nozzle means extends up to the root diameter of said recesses of said conveyor means.

10. An apparatus as claimed in claim 8, wherein: said container orientation means being formed by an upwardly sloping curved member mounted beyond said nozzle means in proximity to said conveyor means, having a highest point of contact with said containers above the center of gravity of said containers.

11. An apparatus as claimed in claim 8, wherein: said container orientation means being formed of a continuous member having a narrowest portion at the point of initial contact with said container and thereafter progressively widening to provide greater surface contact as said containers advance completely out of said recesses of said conveying means.

12. An apparatus as claimed in claim 8, wherein: said container orientation means being defined by a generally crescent shaped flat upwardly sloping member, disposed tangentially of said conveyor means in a space between the edge of said conveyor means and said second abutment means.

13. A method of purging interior surfaces of containers having openings therein, while continuously advancing in a forward direction on a rotatable conveyor provided with a series of recesses for receiving said containers, advancing each of said containers in the opening down position past a cleaning station for the removal of contaminents and thereafter reorienting each of said containers in the opening up position for further handling, said steps including: advancing said opening down containers in proximity to a plurality of pressurized jet streams disposed about and in axial alignment with an arcuate slotted orifice for drawing a vacuum thereacross, each of said containers being positioned in said conveyor means for advancement along an arcuate centerline of said slotted orifice; introducing said jet streams through each of said container opening at a first pressure level, while simultaneously evacuating said each of said container interior through said openings by a vacuum front at a second pressure level; conveying said containers beyond said vacuum front; impinging a single jet stream upon the lower most portion of each of said containers for urging said containers to assume a horizontal position; advancing said containers in a forward direction as contact occurs with a curved guide means for gradually urging said containers to assume an opening up position; and conveying said containers in an opening up position to a next work station.

* * * * *